United States Patent [19]

Chapman

[11] 4,280,519

[45] Jul. 28, 1981

[54] ENVIRONMENTAL MANICURE SYSTEM

[76] Inventor: Virginia J. Chapman, 5556 Peacock La., Riverside, Calif. 92505

[21] Appl. No.: 139,898

[22] Filed: Apr. 14, 1980

[51] Int. Cl.[3] ..... A45D 29/18

[52] U.S. Cl. ..... 132/73.5; 269/222

[58] Field of Search ..... 132/73.5, 73; 269/222; 32/22; 128/376

[56] References Cited

U.S. PATENT DOCUMENTS

| | | | |
|---|---|---|---|
| 2,346,234 | 4/1944 | Reynolds | 132/73.5 |
| 3,258,853 | 7/1966 | Bradbury | 132/73.5 |
| 3,665,867 | 5/1972 | Carlson | 132/73.5 |
| 4,206,556 | 6/1980 | Sabo et al. | 132/73.5 |

*Primary Examiner*—G. E. McNeill

*Attorney, Agent, or Firm*—Paul H. Ware

[57] ABSTRACT

A manicure table providing for the automatic removal of harmful and/or offensive fumes, dust and other materials of like nature resulting from the manicuring process. Where necessary, the harmful materials may be treated so as to render them more easily removable; as, for example, by exhaust.

8 Claims, 1 Drawing Figure

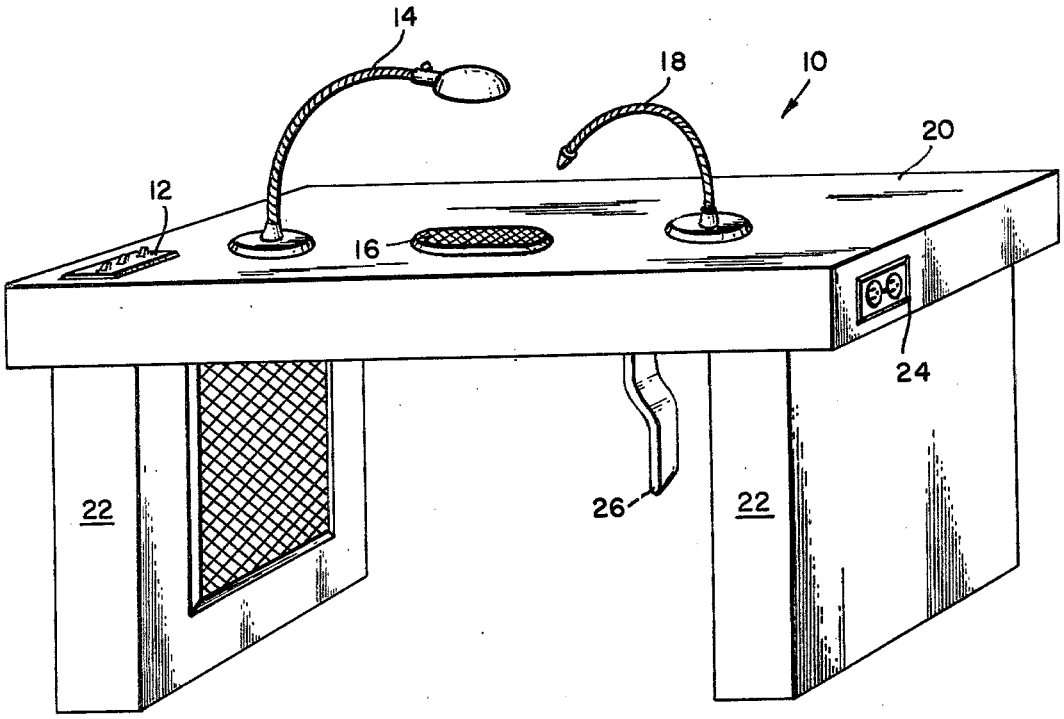
14
18
10
20
12
16
24
22
26
22

ENVIRONMENTAL MANICURE SYSTEM

BACKGROUND OF THE INVENTION

1. Field of the Invention

This invention relates generally to manicuring facilities and more particularly to manicuring facilities featuring the fabrication and application of the new acrylic fingernails.

2. Description of the Prior Art

Manicuring tables are known in which an operator performs the manicuring function on the hands of a patron, including, among other functions, shaping and painting. Manicuring facilities are also available to apply artificial acrylic fingernails, the shaping thereof being usually accomplished using high speed disc grinders, thus, the harmful acrylic dust may be breathed in and/or ingested both by patron and operator alike, all to the detriment of the health of both parties and anyone else in the near vicinity. It is also a fact of experience that the fumes released by the various solvents used in the process are harmful and offensive and can, if inhaled in sufficient concentration, result in unconsciousness and/or some degree of intoxication. Even in the absence of this extreme, the released fumes are at least unpleasant to the senses. It is suspected that these fumes and associated acrylic dust become carcinogenic when encountered in sufficient concentrations. Carried to its dryly logical conclusion, therefore, the harm contemplated may prove fatal.

It would thus be a great advantage to the art to provide a means by which patrons, operators, and others might be relieved of the nauseous and otherwise harmful effects of the manicuring process described.

SUMMARY OF THE INVENTION

In view of the foregoing, it is an object of the present invention to provide a system that will relieve from the harmful effects of nauseous and otherwise harmful fumes and odors encountered in the modern manicuring practice.

A further object is to provide for the removal of dust created in preparing finger and toenails by the modern manicuring and pedicuring methods.

In the accomplishment of these and other objects, an environmental manicure system is provided in which a means for treating the harmful dust and nauseous fumes and odors so encountered is presented. Additional means are provided by way of which the treated residue, if any, may be removed from the immediate environment so that patrons, operators, and others escape the harm inherent in the modern manicuring process. A more efficient illumination means that heretofore available has been incorporated into the system as contemplated by the invention for enhanced operability by serving personnel.

BRIEF DESCRIPTION OF THE DRAWING

Further advantages and features of the present invention will be more fully apparent to those skilled in the art to which the invention pertains from the ensuing detailed description thereof, regarded in conjunction with the accompanying drawing. The drawing is an idealized perspective showing the various elements incorporated into the system and comprising a device featuring a system as contemplated by the invention.

DETAILED DESCRIPTION

Although specific embodiment of the invention will now be described with reference to the drawing, it should be understood that such an embodiment is by way of example and merely illustrative of the many possible specific embodiments which can represent applications of the principles of the invention. Various changes and modifications, obvious to one skilled in the art to which the invention pertains, are deemed to be within the spirit, scope, and contemplation of the invention as further defined in the appended claims.

Referring to the figure with greater particularity, a somewhat conventional table is denoted generally by the numeral 10. Support means 22 form the underpinning for table top 20. Illuminating means 14 is provided as a position-adjustable lamp, thus enhancing the operator's ability to attend to minute detail in the manicuring process. Exhaust means 16 provides a facility by means of which dust and nauseous fumes and odors may be removed from the immediate environment. In the event that such dust and nauseous fumes have a tendency to remain in the vicinity by virtue of their lightness in weight, misting means 18 provides a facility by which these fumes and dust may be rendered more amenable to easy exhaust. Application of a misting spray may be controlled, for example, by misting control means 26.

An important primary facility of misting means 18 is the provision of a cooling function. In the process of shaping the newly formed acrylic fingernails or toenails using the highspeed grinding means, there is an ever-present danger of over-heating and subsequent burning of the carylic nail bed workpiece. Misting means 18 operates also to cool the said workpiece and in that cooling capacity serves to prevent such burning.

Control panel 12 is provided for the operator's convenience in utilizing the various elements of the system of the device. Thus, convenience electrical outlet 24 is provided for the operation of whatever auxiliary electrical devices may be required by the operator. Electrical power may be supplied to convenience electrical outlet 24 by means of the electrical power supplied to the system as a whole, not shown; and there has been described a manicure system that will provide for safe and healthful manicuring with respect to the new acrylic nail systems. Great improvements in ease of operation, health, safety, convenience, and freedom from nauseous and otherwise harmful odors and fumes have been provided through the novel advantages of the invention.

It is here pointed out that although the present invention has been shown and described with reference to particular embodiment, nevertheless, various changes and modifications obvious to one skilled in the art to which the invention pertains are deemed to lie within the purview of the invention.

What is claimed and desired to be secured by Letters Patent of the United States is:

1. An environmental manicure table comprising:

support means;

table top means maintained by said support means;

exhaust means included in said table top means for exhausting offensive materials from the vicinity of said table top means;

misting means included in said table top means for rendering some of said offensive materials into a form more readily exhaustible by said exhaust means;

misting control means for operating said misting means;

illuminating means for enhancing visibility on said table top means;

electrical convenience outlet means for supplying electrical power to auxiliary devices as may be required;

and control panel means for governing the operation of said exhaust means, said misting means, said illuminating means, and said electrical convenience outlet means.

2. The environmental manicure table of claim 1 wherein said exhaust means included in said table top means is adaptable to be connected to an existing air conditioning system.

3. The environmental manicure table of claim 1 wherein said exhaust means included in said table top means incorporates a self-contained vacuum system.

4. The environmental manicure table of claim 1 wherein said misting means includes means for perfuming said misting mean.

5. The environmental manicure table of claim 1 wherein said misting means is a water misting means.

6. The environmental manicure table of claim 1 wherein said misting means includes means to provide medication in said misting means.

7. The environmental manicure table of claim 1 wherein said misting means is position adjustable in said table top means.

8. The environmental manicure table of claim 1 wherein said illuminating means in position adjustable.

* * * * *